US007874450B2

(12) United States Patent
Shibasaka et al.

(10) Patent No.: US 7,874,450 B2
(45) Date of Patent: Jan. 25, 2011

(54) LID FOR BEVERAGE CAN EXCELLENT IN PRESSURE RESISTANT STRENGTH

(75) Inventors: Mamoru Shibasaka, Yokohama (JP); Masaomi Tamura, Yokohama (JP); Hideki Nishimoto, Yokohama (JP)

(73) Assignee: Toyo Seikan Kaishi, Ltd., Tokyo (JP)

( * ) Notice: Subject to any disclaimer, the term of this patent is extended or adjusted under 35 U.S.C. 154(b) by 29 days.

(21) Appl. No.: 12/440,696

(22) PCT Filed: May 14, 2008

(86) PCT No.: PCT/JP2008/058813

§ 371 (c)(1),
(2), (4) Date: Mar. 10, 2009

(87) PCT Pub. No.: WO2008/146599

PCT Pub. Date: Dec. 4, 2008

(65) Prior Publication Data

US 2010/0006571 A1 Jan. 14, 2010

(30) Foreign Application Priority Data

May 30, 2007 (JP) ..... 2007-143629

(51) Int. Cl.
*B65D 6/28* (2006.01)
*B65D 8/04* (2006.01)
*B65D 17/34* (2006.01)

(52) U.S. Cl. ..... 220/619; 220/213; 220/610; 220/623

(58) Field of Classification Search ..... 220/200, 220/213, 269–270, 610, 619, 623, 906
See application file for complete search history.

(56) References Cited

U.S. PATENT DOCUMENTS 7,500,376 B2 * 3/2009 Bathurst et al. ..... 72/348

(Continued)

FOREIGN PATENT DOCUMENTS

JP 2005-119747 A 5/2005

(Continued)

OTHER PUBLICATIONS

Notification of Copies of Translation of the International Preliminary Report on Patentability (Forms PCT/IB/338) of International Application No. PCT/JP2008/058813 mailed Jan. 21, 2010 with forms PCT/IB/373 and PCT/ISA/237.

(Continued)

*Primary Examiner*—Anthony Stashick
*Assistant Examiner*—Madison L Wright
(74) *Attorney, Agent, or Firm*—Westerman, Hattori, Daniels & Adrian, LLP

(57) ABSTRACT

A lid for a beverage can possessing excellent characteristics in pressure resistant strength in which a predetermined pressure requirement is ensured by a simple gauging down. An annular groove portion of the can lid is formed to have such cross-sectional shapes that a panel wall portion is connected to a chuck wall radius portion so that a tangential line at a second contact point is vertical with respect to an axial direction of a center panel portion, while a chuck wall portion is connected to the chuck wall radius portion so that a tangential line at a first contact point is inclined to the radially inner side, and a curved portion with a radius R1 is provided at a height h1 from the lowest point of the chuck wall radius portion and bent to the radially outer side.

4 Claims, 8 Drawing Sheets

U.S. PATENT DOCUMENTS

| | | | | |
|---|---|---|---|---|
| 2006/0071005 | A1 * | 4/2006 | Bulso | 220/619 |
| 2007/0007294 | A1 * | 1/2007 | Jentzsch et al. | 220/619 |

FOREIGN PATENT DOCUMENTS

| | | | |
|---|---|---|---|
| JP | 2006-69603 | A | 3/2006 |

OTHER PUBLICATIONS

International Search Report of PCT/JP2008/058813, Mailing Date of Jul. 22, 2008.

* cited by examiner (Fig.1)
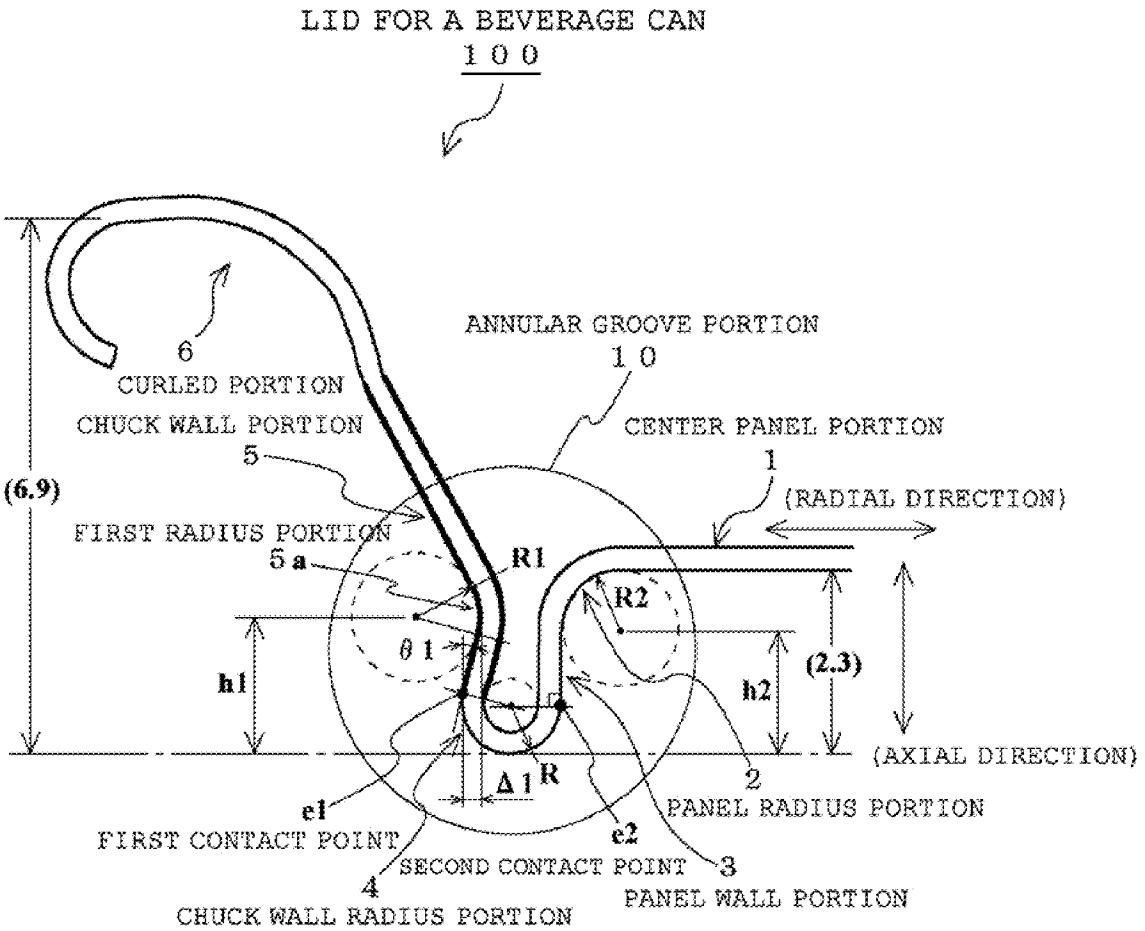

(Fig.2)
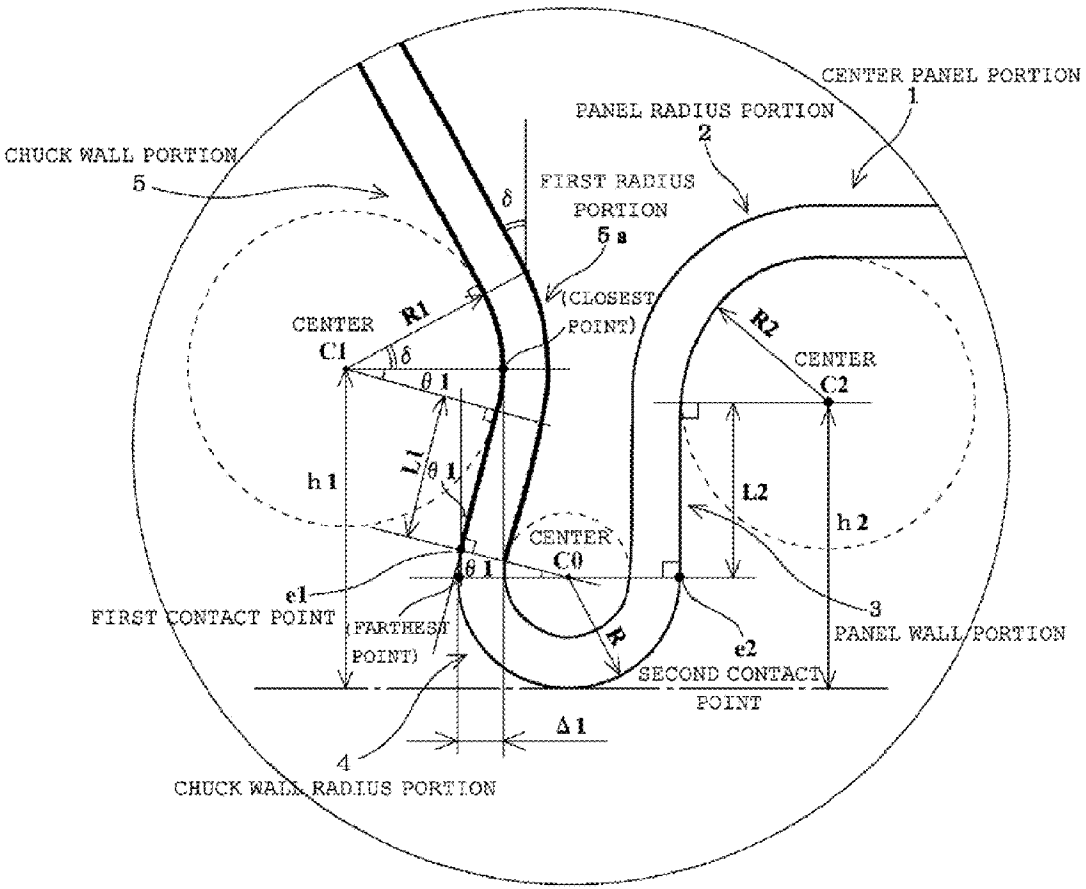

(Fig.3)
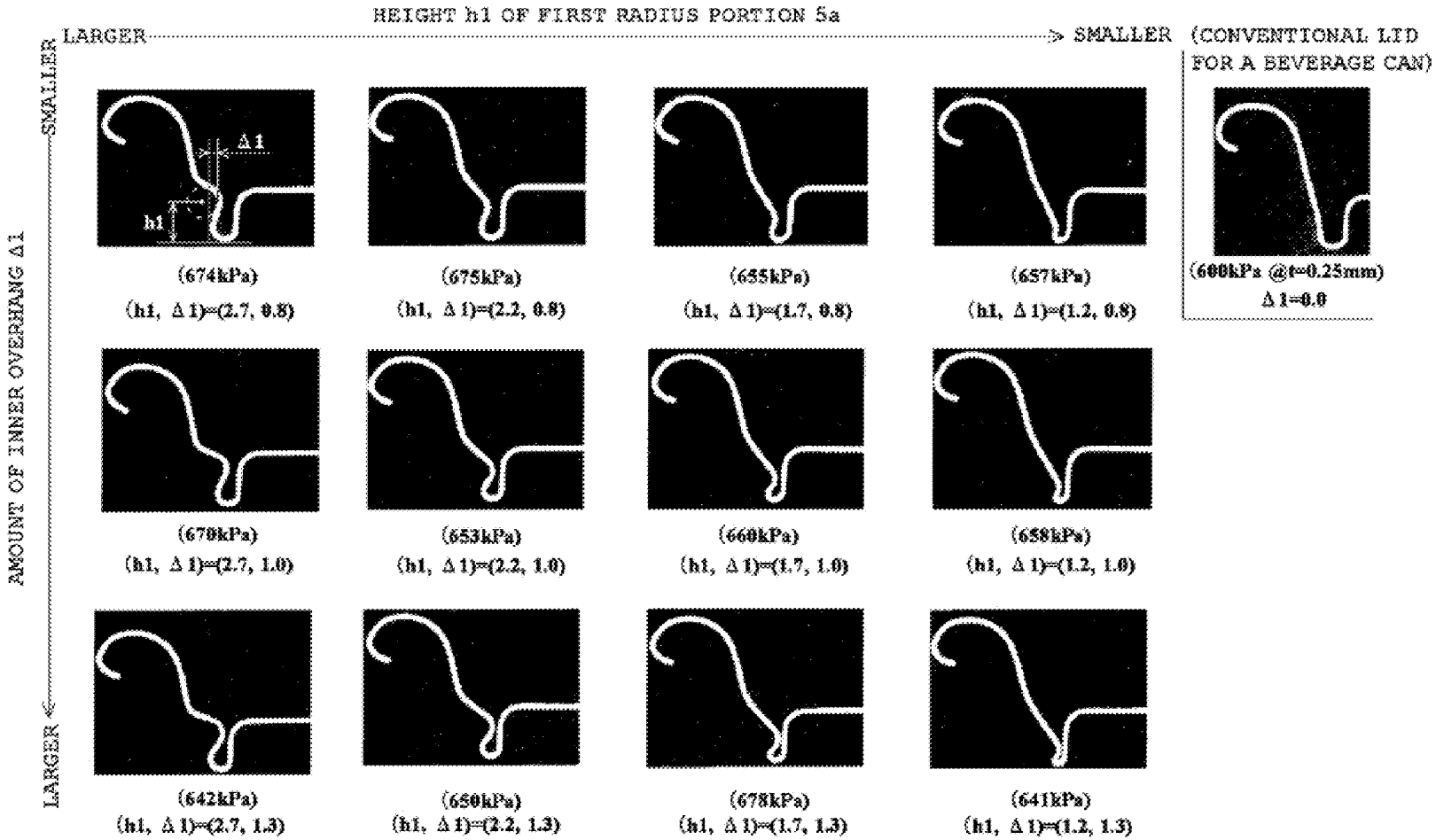

(Fig.4)
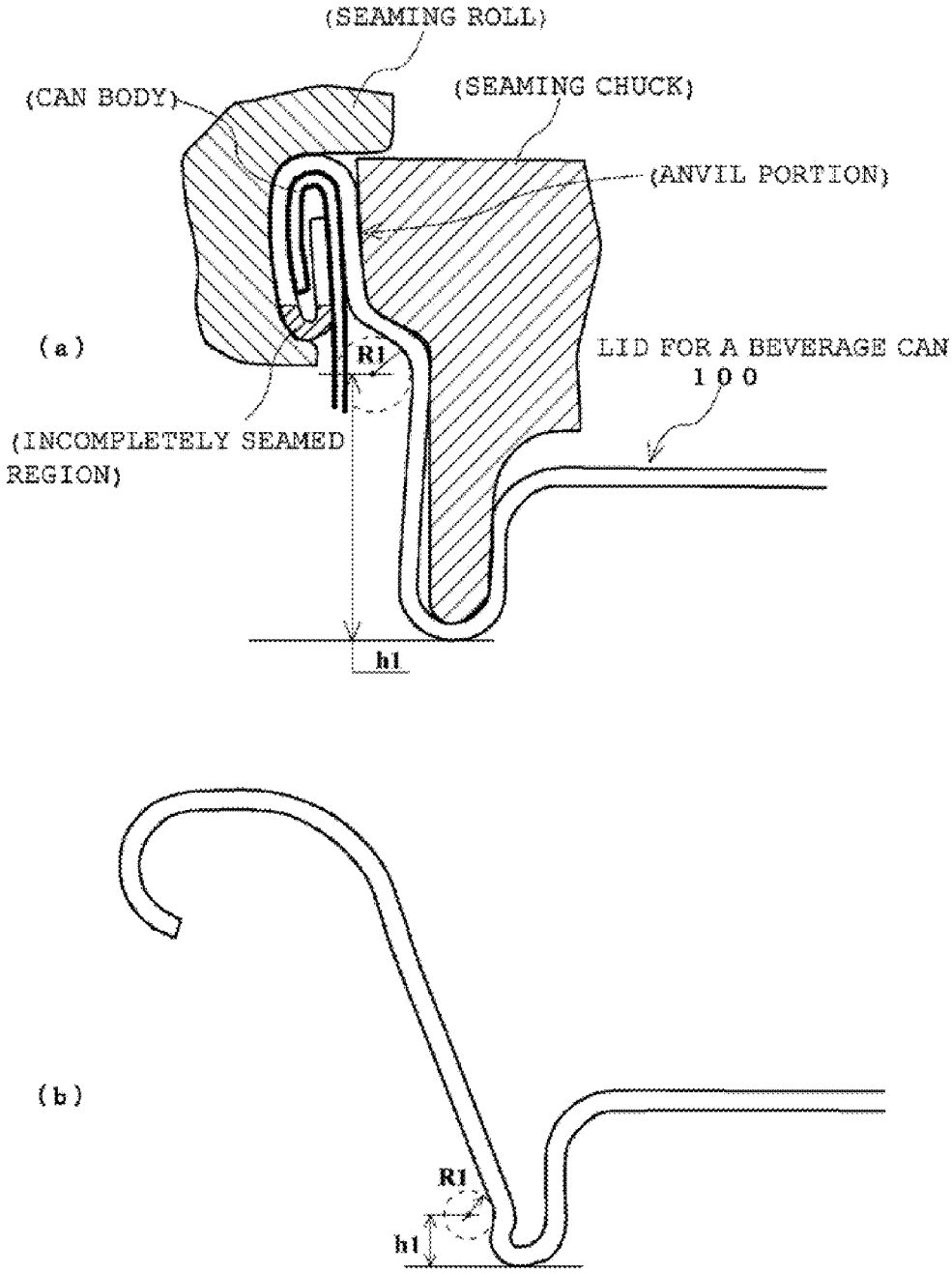

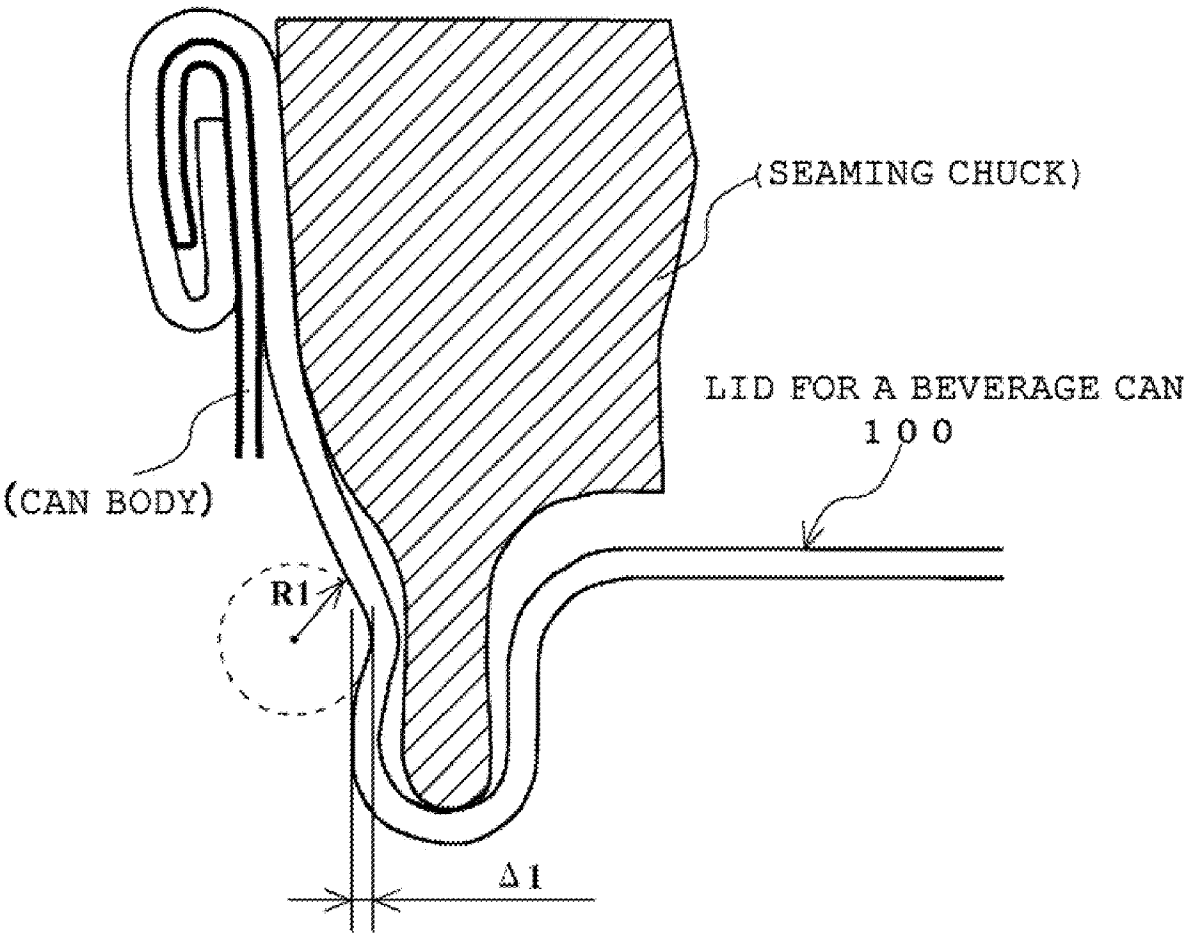
(Fig.5)

(Fig.6)
PRESSURE RESISTANT STRENGTH (206-DIAMETER FULL-FORM END) FOR EACH REFORM FORMATION
| THICKNESS(mm) | [CURRENT SHAPE] 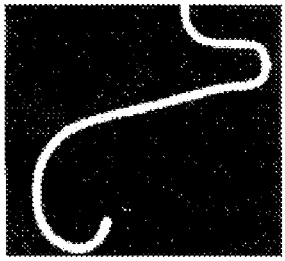 | [REFORM 1] 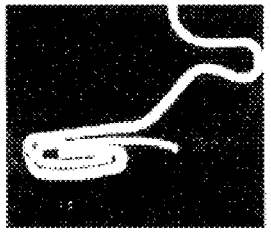 | [REFORM 2] 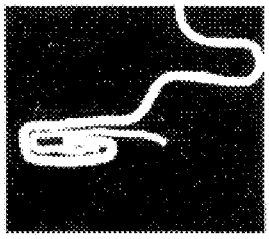 |
|---|---|---|---|
| 0.250t (CURRENT 206 BEER) | 609kPa | 702 kPa | 768 kPa |
| 0.235t Δ0.19g | 583kPa | 714 kPa | 734 kPa |
| 0.220t Δ0.38g | 539 kPa | 648 kPa | 687 kPa |
| (0.210t) Δ0.51g | | 609kPa | |
| 0.200t Δ0.63g | 458 kPa | 563 kPa | 610kPa |

(Fig.7)
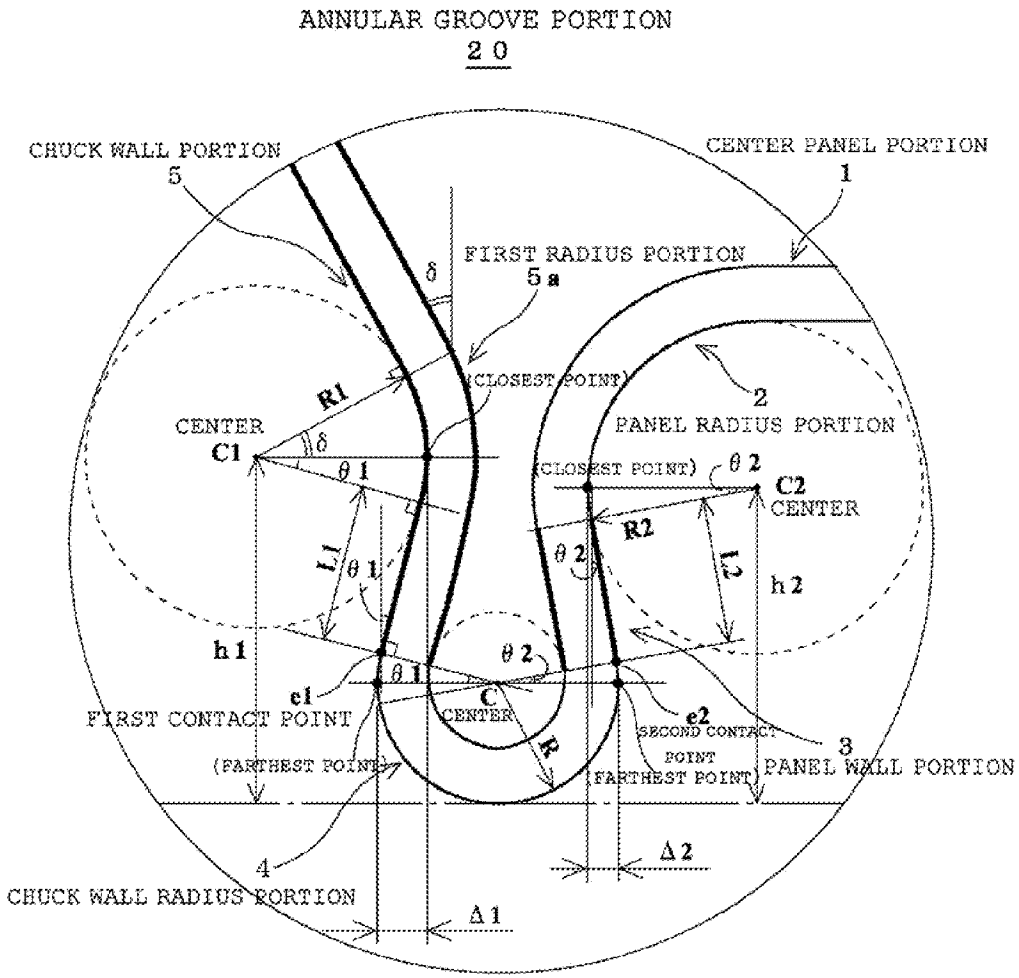

(Fig.8)

PRESSURE RESISTANT STRENGTH (204 DIAMETER)

| THICKNESS (mm) | 【CURRENT SHAPE】 | 【REFORM】 Δ1=0.2 h1=1.6 |
|---|---|---|
| 0.235t | 621 kPa (CURRENT 204 DIAMETER) | 691 kPa |
| 0.220t Δ0.18g | 583 kPa | 663 kPa |
| 0.200t Δ0.37g | 492 kPa | 579 kPa |

LID FOR BEVERAGE CAN EXCELLENT IN PRESSURE RESISTANT STRENGTH

TECHNICAL FIELD

The present invention relates to a lid for a beverage can excellent in pressure resistant strength, and more particularly to a lid for a beverage can excellent in pressure resistant strength in which a predetermined pressure resistant strength can be ensured by simply reducing a thickness.

BACKGROUND ART

A lid for a beverage can has a curled portion thereof and a flange portion of a can body that is filled with contents mated and joined with pressure bonding by a seaming apparatus called "seamer". The beverage can manufactured in such a manner is required to have a predetermined pressure resistant strength. The predetermined pressure resistant strength can be ensured by increasing the thickness of can lid and can body, but from the standpoint of cost reduction and environmental protection, a technology is required that makes it possible to reduce the thickness with the predetermined pressure resistant strength maintained. Accordingly, various can lids have been suggested which have the predetermined pressure resistant strength even if thicknesses are reduced. In particular, various full-form ends in which pressure resistant strength is increased by improving the outer side shape of a center panel portion have been suggested.

One of them is a can lid having a reinforced annular groove portion provided with a plurality of annular grooves, rather than a single annular groove, in which the annular grooves are tilted radially inward (for example, see FIG. 4 of Patent Document 1).

A can lid is also known in which an annular groove is eliminated by folding the outer side of a center panel portion radially inward (for example, see Patent Document 2).

Thus, because the cross-sectional shape of the outer side of a center panel portion greatly affects the pressure resistant strength of cans, various can lids have been suggested that have specific features in the cross-sectional shape thereof in addition to the above.

Patent Document 1: Japanese Patent Application Laid-open No. 2005-119747.

Patent Document 2: Japanese Patent Application Laid-open No. H7-76344.

DISCLOSURE OF THE INVENTION

Problem to be Solved by the Invention

In the above-described conventional can lids, because the degree of margin of pressure resistant strength to the present can lids is very small, a predetermined pressure resistant strength cannot be ensured by simply reducing a thickness (gauging down).

Accordingly, it is an object of the present invention to provide a lid for a beverage can excellent in pressure resistant strength in which a predetermined pressure resistant strength can be ensured by simply reducing a thickness.

Means for Solving the Problem

In order to attain the above-described object, the lid for a beverage can described in claim 1 comprises: a panel radius portion extending radially outward from a center panel portion; a panel wall portion; a chuck wall radius portion; a chuck wall portion; and a curled portion, wherein when a contact point of the chuck wall portion and the chuck wall radius portion is taken as a first contact point and a contact point of the panel wall portion and the chuck wall radius portion is taken as a second contact point, the chuck wall portion is connected to the chuck wall radius portion so that a tangential line at the first contact point is inclined to the radially inner side of the center panel with respect to an axial direction of the center panel, and also extends along the tangential line at the first contact point and is bent at a predetermined bending radius to the radially outer side of the center panel with respect to the axial direction of the center panel, connecting to the curled portion.

The inventors have conducted a comprehensive research of a cross-sectional shape of a can lid that improves the pressure resistant strength of a lid for a beverage can, more specifically a cross-sectional shape of an annular groove portion, and found that the pressure resistant strength of the lid for a beverage can is greatly increased in comparison with the conventional lid for a beverage can, when a shape is produced such that a part of the chuck wall portion is pushed radially further inward of the center panel portion than the chuck wall radius portion, that is, the so-called inner overhang shape is produced.

Accordingly, in the above-described lid for a beverage can, the chuck wall portion in the annular groove portion is connected to the chuck wall radius portion, while inclining to the radially inner side of the center panel with respect to the axial direction of the center panel in the chuck wall radius portion, and formed to have an inner overhang shape that is bent in a predetermined bending radius to the radially outer side of the center panel with respect to the axial direction of the center panel between the chuck wall radius portion and curled portion. As a result, in the lid for a beverage can, a sufficient pressure resistant strength margin can be ensured in comparison with the conventional lid for a beverage can and predetermined pressure resistance capability is ensured by a simple gauging down.

In the lid for a beverage can according to claim 2, when R denotes an outer circumferential radius of the chuck wall radius portion, R1 denotes an inner circumferential radius of a first radius portion within the chuck wall portion connected to the chuck wall radius portion, $\theta 1$ denotes an inclination angle of a straight line portion between the first contact point and the first radius portion with respect to the axial direction of the center panel, h1 denotes a height of a center of the first radius portion from a lowest point of the chuck wall radius portion, and $\Delta 1$ denotes a difference (amount of inner overhang) between a farthest point of the chuck wall radius portion and a closest point of the first radius portion with respect to the radial direction of the center panel, a condition $\Delta 1 = [(h1-R)\sin\theta 1-(R+R1)(1-\cos\theta 1)]/\cos\theta 1>0$ is satisfied.

In the above-described lid for a beverage can, because of the above-described configuration, the amount of inner overhang $\Delta 1$ of the chuck wall portion can be specified by the shape parameters (h1, R, R1, $\theta 1$). Therefore, the inner overhang shape can be easily obtained such that the chuck wall portion is pushed into radially further inner side of the center panel than the chuck wall radius portion by a desired amount $\Delta 1$ at a desired height h1.

In the lid for a beverage can according to claim 3, the panel wall portion is connected to the chuck wall radius portion so that a tangential line at the second contact point is vertical with respect to the radial direction of the center panel.

The inventors have conducted a comprehensive research of a cross-sectional shape of a can lid that improves the pressure resistant strength of a lid for a beverage can, and found that the pressure resistant strength of the lid for a beverage can is increased greatly when the panel wall portion is connected to the chuck wall radius portion so as to be vertical with respect to the radial direction of the center panel portion, particularly in a case where a part of the chuck wall portion is formed to have the inner overhang shape.

Accordingly, in the above-described lid for a beverage can, the pressure resistant strength of the lid for a beverage can is greatly increased by forming the part of the chuck wall portion to have the inner overhang shape and forming the panel wall portion as a vertical wall.

In the lid for a beverage can according to claim 4, the panel wall portion is connected to the chuck wall radius portion so that a tangential line at the second contact point is inclined to the radially outer side of the center panel with respect to the axial direction of the center panel.

The inventors have found that the pressure resistant strength of the lid for a beverage can is greatly increased in comparison with the conventional lid for a beverage can when the panel wall portion is formed to have the so-called outer overhang shape in which the panel wall portion is pushed into the radially further outer side of the center panel than the chuck wall radius portion, particularly in a case where part of the chuck wall portion is formed to have the inner overhang shape.

Accordingly, in the above-described lid for a beverage can, the pressure resistant strength of the lid for a beverage can is greatly increased by forming a part of the chuck wall portion to have the inner overhang shape and forming the part of the panel wall portion to have the outer overhang shape.

In the lid for a beverage can according to claim 5, when R denotes an outer circumferential radius of the chuck wall radius portion, R2 denotes an inner circumferential radius of the panel radius portion, $\theta 2$ denotes an inclination angle of a straight line portion between the second contact point and the chuck wall radius portion with respect to the axial direction of the center panel, h2 denotes a height of a center of the panel radius portion from a lowest point of the chuck wall radius portion, and $\Delta 2$ denotes a difference (amount of outer overhang) between a closest point of the panel radius portion and a farthest point of the chuck wall radius portion with respect to the radial direction of the center panel, a condition $\Delta 2 = [(h2-R)\sin\theta 2-(R+R2)(1-\cos\theta 2)]/\cos\theta 2>0$ is satisfied.

In the above-described lid for a beverage can, because of the above-described configuration, the amount of outer overhang $\Delta 2$ of the panel wall portion can be specified by the shape parameters (h2, R, R2, $\theta 2$). Therefore, the outer overhang shape can be easily obtained such that the panel wall portion is pushed into radially further outer side of the center panel than the chuck wall radius portion by a desired amount $\Delta 2$ at a desired height h2.

Effects of the Invention

With the lid for a beverage can in accordance with the present invention, the pressure resistant strength can be greatly increased in comparison with that of the conventional lid for a beverage can, and a gauging down corresponding to the margin of pressure resistant strength can be achieved.

BRIEF DESCRIPTION OF THE DRAWINGS

FIG. 1 is a principal cross-sectional explanatory drawing illustrating a lid for a beverage can in accordance with the present invention.

FIG. 2 is an enlarged drawing of an annular groove portion of the lid for a beverage can in accordance with the present invention.

FIG. 3 is an explanatory drawing illustrating the relationship between shape parameters (h1, $\Delta 1$) and the pressure resistant strength of the lid for a beverage can in the case that the present invention is applied to the current 206-diameter full-form end.

FIG. 4 is an explanatory drawing illustrating the effective height of the lid for a beverage can in accordance with the present invention.

FIG. 5 is an explanatory drawing illustrating the effective amount of inner overhang of the lid for a beverage can in accordance with the present invention.

FIG. 6 is an explanatory drawing illustrating the gauging down effect in the case that the present invention is applied to the current 206-diameter full-form end.

FIG. 7 is a principal cross-sectional explanatory drawing illustrating an annular groove portion of the lid for a beverage can in accordance with Practical Example 1.

FIG. 8 is an explanatory drawing illustrating the gauging down effect (pressure resistant strength, weight reduction) in the case that the present invention is applied to the current 204-diameter full-form end.

EXPLANATION OF REFERENCE NUMERALS

1 center panel portion
2 panel radius portion
3 panel wall portion
4 chuck wall radius portion
5 chuck wall portion
5*a* first radius portion
6 curled portion
100 lid for a beverage can

BEST MODE FOR CARRYING OUT THE INVENTION

The present invention will be described below in greater detail by embodiments thereof illustrated by the drawings. However, the present invention is not limited to these embodiments.

FIG. 1 is a principal cross-sectional explanatory drawing illustrating a lid 100 for a beverage can in accordance with the present invention. Dimensions in parentheses are reference dimensions relating to a 206-diameter full-form end as a conventional lid for a beverage can.

The lid 100 for a beverage can is configured to have a center panel portion 1 constituting a main portion of a lid surface area, a panel radius portion 2 constituting a portion curved below at an outer edge of the center panel portion 1, a panel wall portion 3 constituting a side wall on the inner side of an annular groove portion extending from the panel radius portion 2 to a chuck wall portion as described below, a chuck wall radius portion 4 constituting a curved portion of a valley portion of the annular groove portion, a chuck wall portion 5 constituting a side wall on the outer side of the annular groove portion extending from the chuck wall radius portion 4 to a curled portion as described below, and a curled portion 6 to be joined with pressure bonding to a can body.

In the lid 100 for a beverage can, the panel wall portion 3 is connected to the chuck wall radius portion 4 so that a tangential line at a second contact point e2 is vertical (with respect to the radial direction of the center panel portion 1), while the chuck wall portion 5 is connected to the chuck wall radius portion 4 so that a tangential line at a first contact point e1 is inclined to the radially inner side (inclined at $\theta 1$ with respect to the axial direction of the center panel portion 1), a curved portion (referred to hereinafter as "first radius portion 5*a*") of a radius R1 is formed at a height of h1 from the lowest point of the chuck wall radius portion 4, and bent to the radially outer side (with respect to the axial direction of the center panel portion 1). Thus, the cross-sectional shape of the chuck wall portion 5 is formed such that the first radius portion 5*a* constitutes a shape (inner overhang shape) that is pushed into radially further inner side by Δ1 from the farthest point of the chuck wall radius portion 4 with respect to the radial direction of the center panel portion 1 at a height of h1 from the lowest point of the chuck wall radius portion 4.

More detailed explanation will be provided below with reference to FIG. 3. By thus imparting the inner overhang shape to the chuck wall portion 5 of the annular groove portion 10, the pressure resistant strength of the lid for a beverage can is greatly increased for the conventional can lid. Furthermore, as will be described below, the inner overhang shape is characterized by a height h1 (referred to hereinafter as "height h1") of the first radius portion 5*a* from the lowest point of the chuck wall radius portion 4 and a pushing amount Δ1 (referred to hereinafter as "amount of inner overhang Δ1") measured from the farthest point of the chuck wall radius portion 4 to the radially inner side of the center panel portion 1, and the increase in the pressure resistant strength of the can lid caused in the inner overhang shape strongly depends on these shape parameters (height h1 and amount of inner overhang Δ1).

FIG. 2 is an enlarged view of the annular groove portion 10 of the lid 100 for a beverage can.

Here, R1 is a size of a radius (inner circumferential) of the first radius portion 5*a*, L1 is a length of a straight line portion (tangential line) between the chuck wall radius portion 4 and the first radius portion 5*a*, θ1 is an inclination of the tangential line at the first contact point e1, R is a size of a radius (outer circumferential) of the chuck wall radius portion 4, R2 is a size of a radius (inner circumferential) of the panel radius portion 2, L2 is a length of a straight line portion (panel wall portion 3) between the panel radius portion 2 and the chuck wall radius portion 4, and when the amount of inner overhang Δ1 is defined as (closest point of the first radius portion 5*a*)−(farthest point of the chuck wall radius portion 4), the amount of inner overhang Δ1 can be represented by:

$$\Delta 1=(R+R1)(1-\cos\theta 1)+L1\sin\theta 1 \quad (1)$$

Meanwhile, the height h1 can be represented as follows:

$$h1=(R+R1)\sin\theta 1+R+L1\cos\theta 1 \quad (2),$$

then the amount of inner overhang Δ1 can be represented as follows by finding L1 from (2), substituting it into (1), and arranging the terms.

$$\Delta 1=[(h1-R)\sin\theta 1-(R+R1)(1-\cos\theta 1)]/\cos\theta 1 \quad (3).$$

As follows from the above equation (3), the amount of inner overhang Δ1 can be uniquely determined by giving shape parameters (h1, R, R1, θ1), and in addition, the cross-sectional shape of the annular groove portion 10 also can be uniquely determined by giving (h2, L2, R2). Furthermore, the equation (3) shows that the amount of inner overhang Δ1 includes shape parameter information relating to (R, R1, θ1), therefore, the cross-sectional shape of the annular groove portion 10 can be specified by the height h1 and the amount of inner overhang Δ1. Incidentally, the shape parameters (h1, R, R1, θ1) of the lid 100 for a beverage can are (h1, R, R1, θ1)=(1.7 mm, 0.6 mm, 1.0 mm, 16°). An angle δ indicates a degree of bending to the radially outer side of the chuck wall portion 5. In this case, δ=28°.

FIG. 3 is an explanatory drawing illustrating the relationship between shape parameters (h1, Δ1) and the pressure resistant strength of the lid for a beverage can in the case that the present invention is applied to the current 206-diameter full-form end.

The pressure resistant strength of the lid for a beverage can is represented by a measured pressure obtained by joining the lid for a beverage can in accordance with the present invention with pressure bonding to a hollow can body in use of a double seaming apparatus (seamer), piercing a bottom portion of the can body with the use of a special needle having an ejection port for a test fluid (water was used in the present embodiment) and a pressure port, and measuring the pressure of water that causes buckling of the lid for a beverage can, while pumping water into the can. The thickness is 0.25 mm.

This figure is an explanatory drawing in which the lids for beverage cans having the shape of the annular groove specified by shape parameters (h1, Δ1) are arranged in the form of a matrix in which the height h1 changes from large to small and the amount of inner overhang Δ1 changes from small to large. The conventional lid for a beverage can that does not have the inner overhang shape is described in the upper zone of right end. According to the figure, the pressure resistant strength of the conventional lid for a beverage can is 600 kPa, whereas in the lid for a beverage can in which the chuck wall portion has the amount of inner overhang, the pressure resistant strength increases as compared with the conventional lid for a beverage can by at least 41 kPa. Thus, by forming the inner overhang shape in the chuck wall portion, it is possible to increase significantly the pressure resistant strength of the lid for a beverage can as compared with the conventional can lid. Furthermore, according to this figure, the height h1 affects the pressure resistant strength of the lid for a beverage can. For example, if the amount of inner overhang Δ1 is increased in the third column (when h1=1.7 mm), the pressure resistant strength increases in proportion to the increase of the amount of inner overhang Δ1, but if the amount of inner overhang Δ1 is increased in the second column (when h1=2.2 mm), pressure resistant strength decreases in inverse proportion to the increase of the amount of inner overhang Δ1. Therefore, the pressure resistant strength of the lid for a beverage can may be expected to be further increased by finding an optimum combination (matching) of the height h1 and the amount of inner overhang Δ1.

Based on FIG. 3, it can be easily supposed that the pressure resistant strength of the can lid can be further increased when a large height h1 is ensured. However, where a large height h1 is ensured, as shown in FIG. 4(*a*), when the lid 100 for a beverage can is seamed with a seaming roll in a state in which the lid is mated with the can body and fixed by a seaming chuck and a lifter (not shown in the figure), a portion (anvil portion) of the seaming chuck that receives the seaming roll is necessarily reduced in size and in the result occurs a risk to produce an incompletely seamed region that could not receive enough seaming load through the seaming roll and the seaming chuck, thereby sealing ability will be degraded in the section of seaming. By contrast, where a small height h1 is ensured, as shown in FIG. 4(*b*), the curvature radius of the distal end portion of the chuck wall radius become extremely small and may damage the coating film on the inner surface. Therefore, in the case of the 206-diameter full-form end of the present embodiment, a value within a range of 0.5<h1<4.5 is preferred as the height h1.

Also, when a large amount of inner overhang Δ1 of the chuck wall portion is ensured, the distal end portion of the seaming chuck cannot be inserted into the annular groove portion of the lid 100 for a beverage can, as shown in FIG. 5.

As a result, seaming with the seamer is impossible. Therefore, in the case of the 206-diameter full-form end of the present embodiment, a value within a range of $0<\Delta 1<1.4$ is preferred as the amount of inner overhang $\Delta 1$.

FIG. 6 is an explanatory drawing illustrating a gauging down effect in the case that the present invention is applied to the current 206-diameter full-form end.

This drawing shows the results obtained in studying a minimum thickness that would be sufficient to satisfy the pressure resistant strength requirement of the conventional lid for a beverage can (current 206-diameter full-form end) in the lid for a beverage can in accordance with the present invention.

In the case of the lid for a beverage can in accordance with the present invention in which the annular groove portion has a shape shown by Reform 1, the pressure resistant strength equivalent to that of the conventional lid for a beverage can is provided even with a simple gauging down of the thickness from 0.25 mm to 0.21 mm, and the weight reduction effect produced by such a gauging down is 0.51 g.

Meanwhile, in the case of the lid for a beverage can in accordance with the present invention in which the counter sink portion has a shape shown by Reform 2, the pressure resistant strength equivalent to that of the conventional lid for a beverage can is provided even with a simple gauging down of the thickness from 0.25 mm to 0.20 mm, and the weight reduction effect produced by such a gauging down is 0.63 g.

With the lid 100 for a beverage can, the pressure resistant strength can be greatly increased (maximum 160 kPa) in comparison with that of thickness and cut edge in aluminum according to specifications identical to those of the current 206-diameter beer full-form end can, and the gauging down in an amount corresponding to the margin of the pressure resistant strength can be attained.

Practical Example 1

FIG. 7 is a principal cross-sectional explanatory drawing illustrating an annular groove portion 20 of a lid for a beverage can of Practical Example 1.

In the annular groove portion 10 of the lid 100 for a beverage can, the first radius portion 5*a* of the chuck wall portion 5 is formed to a shape pushed further radially inward by $\Delta 1$ from the farthest point of the chuck wall radius portion 4 at a height h1, but in the annular groove portion 20 of this lid for a beverage can, in addition to the above-described feature, the panel radius portion 2 is simultaneously formed to a shape (outer overhang shape) pushed still further radially outward by $\Delta 2$ from the farthest point of the chuck wall radius portion 4 at a height h2 from the lowest point of the chuck wall radius portion 4.

As for the amount of outer overhang $\Delta 2$, similarly to the amount of inner overhang $\Delta 1$, it is possible to find the amount of outer overhang $\Delta 2$ as $\Delta 2=[(h2-R)\sin\theta 2-(R+R2)(1-\cos\theta 2)]/\cos\theta 2$ by performing substitutions $h1\rightarrow h2$, $R1\rightarrow R2$, and $\theta 1\rightarrow\theta 2$ in the equation (3). Therefore, the cross-sectional shape of the annular groove portion 20 of this lid for a beverage can be also specified by the shape parameters (h1, $\Delta 1$) and shape parameters (h2, $\Delta 2$) similarly to the cross-sectional shape of the annular groove portion 10.

Furthermore, the bending radius (curvature radius) and center (curvature center) of the chuck wall radius portion 4 in the present embodiment are the same over the entire circumference, but such a configuration is not limiting, and the above-described features can be similarly applied even when each of the curvature radii or each of the curvature centers respectively differs in the both side of the panel wall portion 3 and the side of the chuck wall portion 5.

Practical Example 2

FIG. 8 is an explanatory drawing illustrating the gauging down effect (pressure resistant strength, weight reduction) in the case that the present invention is applied to the current 204-diameter full-form end.

In the case of the lid for a beverage can in accordance with the present invention in which the annular groove portion is molded to a shape shown in reform ($\Delta 1$=0.2, h1=1.6), when the thickness is 0.235 mm equal to that of the current 204-diameter full-form end, the pressure resistant strength becomes 691 kPa and has a pressure resistant strength margin of 70 kPa in comparison with that of the current 204-diameter full-form end.

By simple gauging down from 0.235 mm to 0.220 mm in the thickness of the lid for a beverage can in accordance with the present invention, the pressure resistant strength (663 kPa) and the pressure resistant strength margin of 42 kPa were provided in comparison with that of the current 204-diameter full-form end (t=0.235 mm). The weight reduction effect caused by the gauging down is 0.18 g in comparison with that of the current 204-diameter full-form end (t=0.235 mm).

As for the height h1 in the case that the present invention is applied to the 204-diameter full-form end, when a large height h1 is ensured, there is a risk that an incompletely caulked region will be produced and sealing ability will be degraded in the section of seaming, as shown in FIG. 4(*a*), in the same manner as in the case of the 206-diameter full-form end. By contrast, where a small height h1 is ensured, as shown in FIG. 4(*b*), the curvature radius of the chuck wall radius can become extremely small and may damage the coating film on the inner surface. Therefore, in the case that the present invention is applied to the 204-diameter full-form end, a value within a range of $0.5<h1<4.5$ is preferred as the height h1.

Furthermore, concerning the amount of inner overhang $\Delta 1$ in the case that the present invention is applied to the 204-diameter full-form end, when a large amount of inner overhang $\Delta 1$ is ensured, as shown in FIG. 5, the distal end portion of the seaming chuck cannot be inserted into the annular groove portion of the lid for a beverage can, similarly to the case of the 206-diameter full-form end. As a result, seaming with the seamer becomes impossible. Therefore, in the case that the present invention is applied to the 204-diameter full-form end, a value within a range of $0<\Delta 1<1.4$ is preferred as the amount of inner overhang $\Delta 1$.

INDUSTRIAL APPLICABILITY

The present invention can be preferably applied to all the lids for beverage cans that have annular grooved portions.

The invention claimed is:

1. A lid for a beverage can, comprising:

a panel radius portion extending radially outward from a center panel portion;

a panel wall portion;

a chuck wall radius portion;

a chuck wall portion; and a curled portion, wherein, when a contact point of the chuck wall portion and the chuck wall radius portion is taken as a first contact point and a contact point of the panel wall portion and the chuck wall radius portion is taken as a second contact point, the chuck wall portion is connected to the chuck wall radius portion so that a tangential line at the first contact point is inclined to a radially inner side of the center panel with respect to an axial direction of the center panel, and the chuck wall also extends along the tangential line at the first contact point and is bent at a predetermined bending radius to the radially outer side of the center panel with respect to the axial direction of the center panel, connecting to the curled portion, and wherein, (h1) denotes a height of a center of a first radius portion within the chuck wall portion connecting to the chuck wall radius portion measured from a lowest point of the chuck wall radius portion, and (Δ1) denotes a difference (amount of inner overhang) between a farthest point of the chuck wall radius portion and a closet point of the first radius portion with respect to the radial direction of the center panel, wherein conditions of $0<\Delta 1<1.4$ and $0.5<h1<4.5$ are satisfied.

2. The lid for a beverage can according to claim 1, wherein the panel wall portion is connected to the chuck wall radius portion so that a tangential line at the second contact point is vertical with respect to the radial direction of the center panel.

3. The lid for a beverage can according to claim 1, wherein the panel wall portion is connected to the chuck wall radius portion so that a tangential line at the second contact point is inclined to the radially outer side of the center panel with respect to the axial direction of the center panel.

4. The lid for a beverage can according to claim 3, wherein, when (R) denotes an outer circumferential radius of the chuck wall radius portion, (R2) denotes an inner circumferential radius of the panel radius portion, (θ2) denotes an angle of a straight line portion between the second contact point and the chuck wall radius portion with respect to the axial direction of the center panel, (h2) denotes a height of a center of the panel radius portion from a lowest point of the chuck wall radius portion, and (Δ2) denotes a difference (amount of outer overhang) between a closest point of the panel radius portion and a farthest point of the chuck wall radius portion with respect to the radial direction of the center panel, a condition $\Delta 2=[(h2-R)\sin\theta 2-(R+R2)(1-\cos\theta 2)]/\cos\theta 2>0$ is satisfied.

* * * * *